United States Patent [19]

Martin

[11] Patent Number: 4,716,753

[45] Date of Patent: Jan. 5, 1988

[54] FLEXIBLE TUBE EXPANDER EXTENSION ASSEMBLY

[75] Inventor: Paul W. Martin, Springfield, Ohio

[73] Assignee: Dresser Industries, Inc., Dallas, Tex.

[21] Appl. No.: 880,728

[22] Filed: Jul. 10, 1986

[51] Int. Cl.[4] ..... B21D 41/02

[52] U.S. Cl. ..... 72/122; 72/123; 464/112; 29/727

[58] Field of Search ..... 72/122, 123, 465, 466, 72/126; 464/112, 149, 170, 173, 179, 182, 51, 88; 29/727

[56] References Cited

U.S. PATENT DOCUMENTS

| | | | |
|---|---|---|---|
| 1,314,601 | 9/1919 | McCaskey | 464/149 |
| 1,530,381 | 3/1925 | Leedom | 72/123 |
| 2,649,889 | 8/1953 | Dudley | 29/727 |
| 3,854,314 | 12/1974 | Martin | 72/122 |
| 4,134,286 | 1/1979 | Martin | 72/122 |
| 4,196,609 | 4/1980 | Sugino et al. | 29/727 |
| 4,232,442 | 11/1980 | Brunaud | 72/122 |
| 4,242,893 | 1/1981 | Diller | 72/122 |
| 4,472,075 | 9/1984 | Forni | 464/112 |

OTHER PUBLICATIONS

Airetool Tube Cleaners Tube Expanders Catalog CE-102, Dresser Industries, Inc., pp. 26, 37, 38, 40, 41, and 42.

*Primary Examiner*—Lowell A. Larson

[57] ABSTRACT

A flexible extension assembly for use with a tube expander of the type having an expanding head which has internal apparatus driven for tube expansion by a drive device connected coaxially thereto with a spacer for locating the expanding head at a predetermined distance from the end of the tube to be expanded. The flexible extension assembly comprises a rigid hollow extension segment pivotably connected at one end to the expanding head and pivotably connected at the other end to the spacer so that the extension segment is pivotable into and out of coaxial alignment with the tube to be expanded, and an extension link slidably carried in the hollow rigid extension segment and pivotably connected at one end to the internal apparatus and pivotably connected at its other end to the drive shaft so that the extension link is pivotable with the extension segment into and out of coaxial alignment with the tube to be expanded.

6 Claims, 7 Drawing Figures

FLEXIBLE TUBE EXPANDER EXTENSION ASSEMBLY

BACKGROUND OF THE INVENTION

The invention relates to an extension assembly for use with a tube expander of the type which is inserted into a tube for expanding the tube into rigid engagement with structural supports. A bank of such tubes may, for example, form a heat exchanger, the construction of which requires each tube to be rigidly expanded into a sheet which supports the tubes.

Tube expanders typically require the ability to provide substantial rotational force to an expanding head while the expanding head simultaneously provides radially outward pressure so that the metal tubes can be sufficiently deformed to provide rigid engagement. The support sheets or frame work of sheets into which the tube must be expanded are typically at multiple distances along the length of the tube so that the expander must be inserted substantial distances into the tube. Where the entry end of the tube is not adjacent any other structure, straight rigid extensions can be used without difficulty. However, where the end of the tube is blocked so that a straight extension cannot be used, flexible extensions are required so that the tube expander can be inserted a sufficient distance into the tube while the flexible extension is bent for entry into the tube.

With prior art flexible extensions, difficulties arise, for example, where the tube expander is of the type which has rollers held in cages which rollers are pushed radially outward by an internal mandrel it is necessary to have one flexible mandrel extension inside a flexible tube extension. The forces which can be applied using continuously flexible tubing such as coiled spring tubing is limited and often not sufficient to provide adequate rotational force to provide the tube expansion and rigidity of engagement required. Problems of extender deformation result. Also problems of inadequately expanded tube engagement may result.

There is also a severe space constraint as the inside diameter of the tubes can be less than one-fourth of an inch (6.35 millimeters) in diameter. Thus, there is often insufficient room to provide universal joint connections with sufficient strength to ensure adequate torsional force applied to the expansion head or roller cage.

BRIEF SUMMARY OF THE INVENTION

The foregoing problems are overcome by the present invention which provides a flexible tube expander extension assembly for insertion into the end of a tube which is to be expanded at a predetermined distance from the tube end, the tube expander comprises a tubular cage, forming rollers carried by the cage, a mandrel coaxially through the tubular cage for rolling engagement with the forming rollers, a depth adjustment casing, a rotatable drive shaft extending through the depth adjustment casing for driving the mandrel in rolling engagement with the rollers, a thrust collar adjustably fastenable along the length of the depth adjustment casing for rotatably locating the cage rollers and mandrel the predetermined distance from the end of the tube to be expanded, at least one cage extension segment pivotably connected at one of its ends to the tubular cage and pivotably connected at its other end to the depth adjustment casing so that the segment is pivotable into and out of coaxial alignment with the cage and the casing, and at least one mandrel extension link slidably carried in the cage extension segment coaxial therewith and pivotably connected to the mandrel at one end of the link substantially coterminous with one end of the segment and pivotably connected to the drive shaft at the other end of the link substantially coterminous with the other end of the segment so that the link is pivotable into and out of coaxial alignment with the mandrel and the drive shaft when the cage extension segment is pivoted into and out of coaxial alignment with the tubular cage and the depth adjustment casing.

DETAILED DESCRIPTION OF THE DRAWINGS

Figure 1:
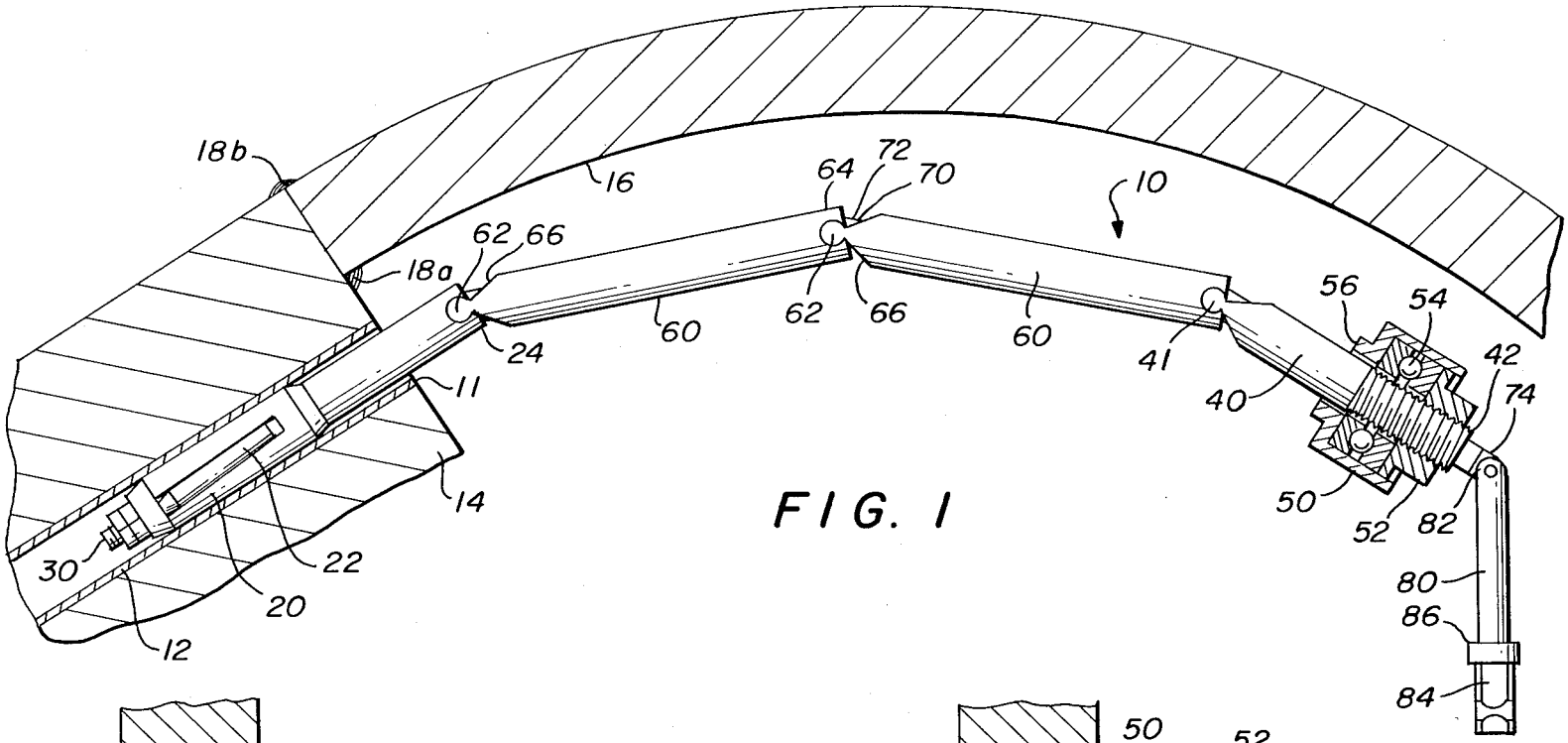
FIG. 1 is an elevation view of the flexible tube expansion assembly shown in its flexed configuration for insertion into a typical work piece tube and structural support shown in cross-section.

The foregoing benefits and other objects and advantages of the invention will become more apparent as the following detailed description is read in conjunction with the accompanying drawings, wherein like reference characters denote like parts in all views.

Referring to the drawings, and to FIG. 1 in particular, shown therein and generally designated by reference character 10 is a flexible tube expander extension assembly constructed in accordance with the preferred embodiment of the invention. As illustrated therein, the flexible tube expander extension assembly 10 is in position for insertion into a tube 12 in a structural support 14 which may be a sheet 14 with an obstruction 16 such as a spherical head portion of a heat exchange 16 nonremovably affixed as by welds 18*a* and b such that there is insufficient room to insert a straight tube expander having a sufficient length to reach the maximum depth into tube 12 at which tube 12 is to be expanded.

The flexible tube expander extension assembly includes an expansion head 20 which may be a tubular cage 20 which carries forming rollers 22. Forming rollers 22 are driven for expansion by internal means 30, for example, as by rolling contact with mandrel 30 which is carried coaxially through tubular cage 20. In the preferred embodiment the mandrel 30 is a tapered mandrel with correspondingly tapered rollers 22 formed of hardened bearing steel. Cage 20 is preferably formed of drawn and hardened metal.

At the opposite end of flexible tube expander 10 there is a spacer means 40 which may be a depth adjustment casing 40 having means 42 such as threads 42 along its length or at least a portion of its length at which a thrust collar 50 is adjustably fastenable for ultimately locating cage 20 with rollers 22 and mandrel 30 therein at a predetermined distance from the end 11 of tube 12. Thrust collar 50 includes means 52 which may be a threaded collar 52 which is fastenable to means 42 for adjustably fastening thrust collar 50 along the length of depth adjustment casing 40. Upon fastening thrust collar 50 to depth adjustment casing 40, casing 40 is permitted to rotate as by bearing assembly 54.

Figure 2:
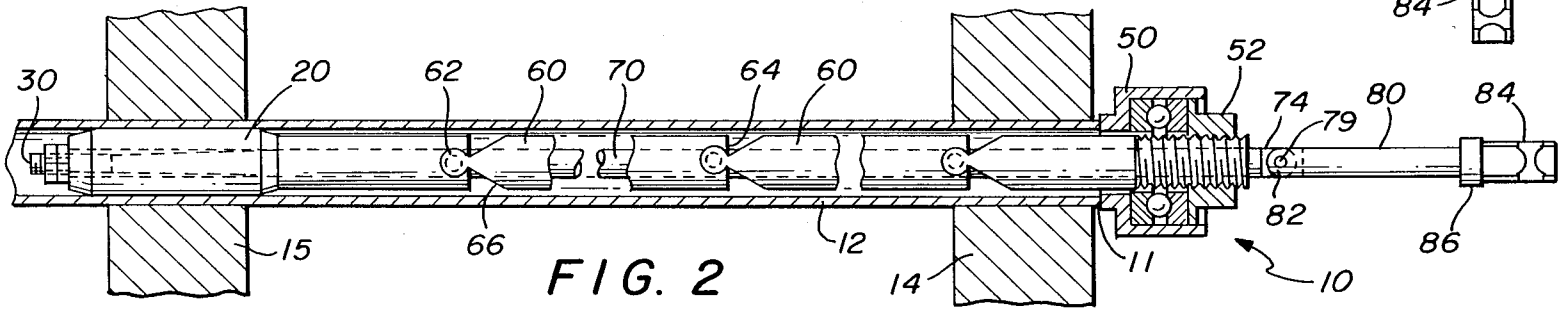
FIG. 2 is a partially cut away elevation view of the flexible tube expansion assembly in its coaxially aligned rotationally operable position inside a tube to be expanded shown in cross-section.

With reference being had also to FIG. 2, it is shown that flexible tube expander extension 10 is in a straightened position so that the rollers are held at an operational depth from the end 11 of tube 12. With reference being had again to FIGS. 1 and 2 tube expander 10 includes at least one rigid hollow extension segment 60 which is preferably a cage extension segment 60 and which is pivotably connected at one end 62 to cage 20. In the case where there is only one cage extension segment 60 it is connected at 41 at its other end 64 to the spacer means 40 or depth adjustment casing 40. It can be seen that multiple cage extension segments 60 can be used to achieve any desired operational length as required. In the preferred embodiment in order to achieve the minimum bending radius while maintaining the maximum strength each of the extension segments 60 is of substantially equal length corresponding to the clearance distance between tube end 11 and any given obstruction 16.

Where multiple cage extension segments 60 are used each segment is pivotably connected to each other segment end to end to form a flexible chain of segments, one of which segments 60 is pivotably connected at one end of said chain to said tubular cage 20 and another of which segments 60 is pivotably connected at the other end of said chain of segments to the depth adjustment casing 40 so that the entire chain of segments is pivotable into coaxial alignment, as in FIG. 2, and out of coaxial alignment as in FIG. 1, with the cage and casing. This results in substantially complete coaxial alignment with the tube to be expanded. The cage extension segments are hollow as is the tubular cage for slidably carrying at least one extension link 70 such as mandrel extension link 70 substantially coaxially therein. Where there is only one cage extension segment 60 there can also be only one mandrel extension link 70 and it is pivotably connected to the internal means 30 such as mandrel 30 at one end 72 of the mandrel extension link. The link connection should be substantially coterminous with the one end 62 of segment 60 which is pivotably connected to the tubular cage 20. Again, in the case where there is only one mandrel link 70, the other end 74 is pivotably connected to drive shaft 80. The connection at the other end 74 is substantially coterminous with the other end 64 of the segment 60 which connects to the casing 40 at 41 so that the link is pivotable into coaxial alignment with said mandrel 30 and said drive shaft 80 when said cage extension segment 60 is pivoted into coaxial alignment with said tubular cage 20 and said depth adjustment casing 40 and the link 70 is pivotable out of coaxial alignment with the mandrel and the drive shaft when the cage extension segment is pivoted out of coaxial alignment with the tubular cage and the depth adjustment casing 40. Thus, the entire flexible tube expander extension assembly may be inserted into tube 12 for expansion into a support sheet 14 a given depth from the end. The tube may be expanded into rigid engagement with support portion 15 a substantial distance from tube end 11.

Where there are multiple cage extension segments 60 there are also necessarily multiple mandrel extension links 70 equal in number and substantially equal in length to said multiple cage extension segments 60. As shown in FIGS. 1 and 2 there can be an additional extension link 70 through said spacer means 40 so that drive shaft 80 is pivotable adjacent threaded portion 40. Each link is pivotably attached to each other link end to end to form a flexible series of links, one of which is pivotably connected at one end of the series to the mandrel 30 and another link is pivotably connected at the other end of the series to the drive shaft 80 so that the entire series of links 70 is pivotable into (as shown in FIG. 2) and out of (as shown in FIG. 1) coaxial alignment with the mandrel 30 and the drive shaft 80 when the chain of cage extension segments is pivoted into and out of coaxial alignment with the tubular cage 20 and the depth adjustment casing 40. Thus, the entire flexible tube expander extension assembly 10 is insertable into tube 12 as in FIG. 1 pivotable to an operating position coaxially with tube 12 as in FIG. 2. Where extension segments 60 are equal in number to extension links 70, drive shaft 80 is necessarily sized to be extendable through spacer 40. Where an additional link 70 extends through spacer means 40, drive shaft 80 will be sized, as shown in FIGS. 1 and 2, for insertion through spacer means 40. In either case, it will further be understood that the entire series of links 70 and drive shaft 80 taken together will be slidable through cage extensions 60 and spacer 40 a sufficient distance to cause mandrel 30 to push rollers 22 outward to adequately expand tube 12 for rigid engagement with support 15.

Figure 3:
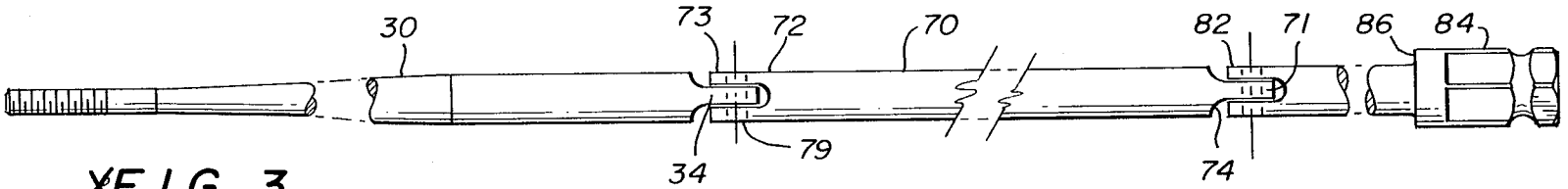
FIG. 3 is a side elevation view of a mandrel, mandrel extension link and mandrel drive shaft of the preferred embodiment of the extension assembly.
Figure 4:
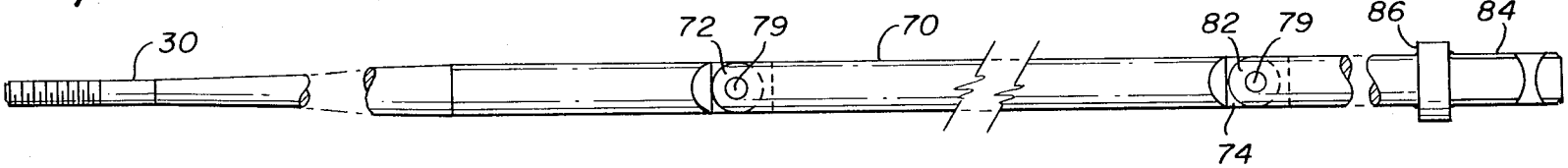
FIG. 4 is a top elevation view of the mandrel, the mandrel extension link, and the mandrel drive shaft.
Figure 7:
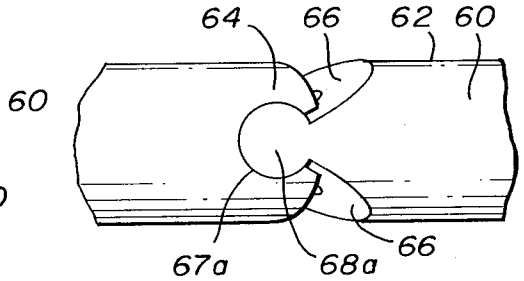
FIG. 7 is a partial perspective view of the connection between extension segments.

With reference being had to FIG. 3 and FIG. 4, it can be seen that the pivotable connections of the mandrel 30, the mandrel links 70 and the drive shaft 80 are, in the preferred embodiment, a female fork 73 and corresponding male projection 71 with a pin 79 therethrough. This connection is typical at each end of the mandrel 30, the links 70 and the drive shaft 80 which are to be pivotably connected. Preferably, so that multiple links 70 may be added to any given flexible tube expander assembly each link has at one end thereof the female fork 73 and at the other end thereof the male projection 71 so that they may be connected end to end. It will be understood by those skilled in the art that the mandrel 30 may have the male projection 71 formed thereon provided the drive shaft 80 has the female fork 73 thereon; alternatively, the mandrel 30 may have the female fork 73 provided the drive shaft 80 has the male projection 71.

Figure 5:
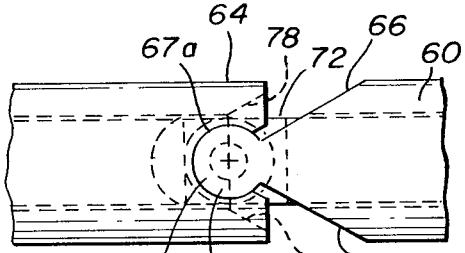
FIG. 5 is a side view of a pivot connection between cage extension segments with a pivot connection between mandrel extension link shown with hidden lines.
Figure 6:
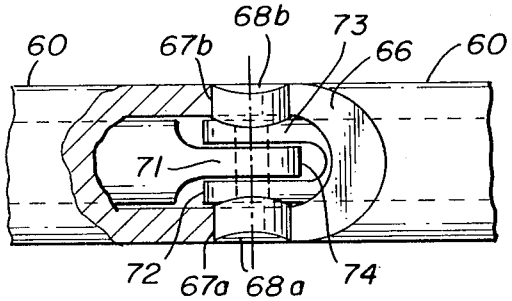
FIG. 6 is a top elevation view in partial cut away section showing the details of the pivotable connections between the cage extension segments and the mandrel extension links of the preferred embodiment.

With reference to FIGS. 5 and 6, it is shown that the connection at end 62 of the cage extension segments comprises two circular arc shaped ears **68*a* and 68*b* formed thereon which are coaxial with each other along a first pivot axis which is perpendicular to the cage extension segments. The circular arc shaped ears 68*a* and 68*b* define in the side view a circular arc of more than 180°. Preferably the arc is approximately 240° so that a rigid connection will be formed with the corresponding circular arc openings 67*a* and 67*b* formed in the other end 64 of the extension segment. Preferably, the ears 68*a* and 68*b* are formed at one end 62 of each cage extension segment and the openings 67*a* and 67*b* are formed at the other end 64 so that additional segments can be added as necessary to achieve the depth required. It will also be understood by those skilled in the art that the tubular cage may have formed thereon circular arc openings 67***a* and 67*b* corresponding to the extension segment ears 68*a* and 68*b* or alternatively it may have ears 68*a* and 68*b* formed thereon corresponding to the extension segment openings 67*a* and 67*b*. In each such case it will be preferable to have the opposite connection component formed on the depth adjustment casing so that an unlimited number of extension segments 60 can be added as necessary to achieve the desired depth.

In the preferred embodiment each end 64 at which circular arc openings are formed will also be provided with channel relief portions 79 sufficiently large to permit clearance room for the mandrel links 70 when the flexible tube expander extension assembly 10 is in its flexed or bent position.

It should be further understood that in the preferred embodiment to achieve maximum strength with minimum bending radius the pivot axis at each end of the tube expander extension segments and at each end of the mandrel extension links will be perpendicular to the axis of rotation and each pivot axes will be parallel to each other pivot axis such that the chain of segments and series of links are flexible in only one plane which is perpendicular to each of the pivot axes. The mandrel links 70 and the extension segments 60 each must connect along corresponding pivot axes at each end. To be operationally rotated all of the segments and links must be substantially in complete coaxial alignment, i.e. straight along the length of the tube to be expanded so that drive shaft 80 may be rotated at coupling means 82 by a rotary machine (not shown) such as a known drill motor or other power rotary tool. Thus, mandrel links 70 are rotated through the pivot connections at pin 79 and within segment 60. Through the continuous chain of connections mandrel 30 is rotated, which mandrel 30 drives rollers 22 in rolling engagement with the inside of tube 12. Rollers 22 thus drive cage 20 with rotation motion in the same direction as the rotation of mandrel 30 but typically at a different rotary speed. Each of the extension segments 60 and the depth adjustment casing 40 are thus rotated. Thrust collar 50 permits this rotation as by bearing 54. It will be understood that thrust collar 50 may be any of a number of known thrust collars of various shapes and configurations.

While the invention has been described in connection with a preferred embodiment, it is not intended to limit the scope of the invention to the particular form set forth, but, on the contrary, it is intended to cover such alernatives, modifications, and equivalents as may be included within the spirit and scope of the invention as defined in the appended claims.

I claim:

1. A flexible extension assembly for use with a tube expander of the type having an expanding head which has internal tube expanding means driven for tube expansion by a drive means connected coaxially thereto with spacer means for locating said expanding head at a predetermined distance from the end of the tube to be expanded, said flexible extension assembly comprising:

a. at least one rigid hollow extension segment pivotably connected at one end to said expanding head and pivotably connected at the other end to said spacer means so that said extension segment is pivotable into and out of coaxial alignment with said expanding head; and b. at least one extension link slidably carried in said hollow extension segment and pivotably connected at one end to said internal tube expanding means and pivotably connected at its other end to said drive means so that said extension link is pivotable with said extension segment into and out of coaxial alignment with said expanding head.

2. A flexible tube expander extension assembly for insertion into and end of a tube which is to be expanded at a predetermined distance from said tube end, said tube expander comprising:

a. a tubular cage having an axis of rotation;

b. forming rollers carried by said cage;

c. a mandrel extending coaxially along said axis of rotation through said tubular cage for rolling engagement with said rollers;

d. a depth adjustment casing;

e. a rotatable drive shaft for receiving force for driving said mandrel in said rolling engagement with said rollers;

f. a thrust collar adjustably fastenable along the length of said depth adjustment casing for rotatably locating said cage, rollers and mandrel said predetermined distance from the end of said tube to be expanded;

g. at least one cage extension segment pivotably connected at one end to said tubular cage and pivotably connected at the other end to said depth adjustment casing so that said segment is pivotable into and out of coaxial alignment with said cage and said casing; and h. at least one mandrel extension link for transmitting said force from said drive shaft to said mandrel and slidably carried in said cage extension segment coaxially therewith and pivotably connected to said mandrel at one end of said link substantially coterminous with one end of said segment and pivotably connected to said drive shaft at the other end of said link substantially coterminous with the other end of said segment so that said link is pivotable into and out of coaxial alignment with said mandrel and said drive shaft when said cage extension segment is pivoted into and out of coaxial alignment with said tubular cage and said depth adjustment casing.

3. A flexible tube expander as in claim 2 further comprising:

a. a first set of two circular arc shaped ears formed at one end of said cage extension segment along a first pivot axis which pivot axis is perpendicular to the rotation axis of said extension segment;

b. a portion of the end of said cage defining a first set of two circular arc shaped openings each of which is sized for pivotable engagement with said first set of ears about said first pivot axis which is perpendicular to the rotation axis of said extension segment;

c. a portion of the other end of said cage extension segment defining a second set of circular arc shaped openings along a second pivot axis perpendicular to said rotation axis of said extension segment; and d. a second set of two circular arc shaped ears formed at an end of said depth adjustment casing sized for pivotable engagement with said second set of circular arc shaped openings about said second pivot axis.

4. A flexible tube expander as in claim 2 further comprising:

a. a portion of one end of said cage defining a first set of two circular arc shaped openings each along a first pivot axis which is perpendicular to the rotation axis of said extension segment;

b. a first set of two circular arc shaped ears formed at one end of said cage extension segment each of which circular arc shaped ears is sized for pivotable engagement with said first set of openings about said first pivot axis;

c. a second set of two circular arc shaped ears formed at the other end of said cage extension segment along a second pivot axis perpendicular to said rotation axis of said extension segment; and d. a portion of one end of said depth adjustment casing defining a second set of two circular arc shaped openings sized for pivotable engagement about said second pivot axis.

5. A flexible tube expander for insertion into an end of a tube which is to be expanded at a predetermined distance from said tube end, said tube expander comprising:

a. a tubular cage;

b. forming rollers carried by said cage;

c. a mandrel extending coaxially through said tubular cage for rolling engagement with said rollers;

d. a depth adjustment casing;

e. a rotatable drive shaft for receiving force for driving said mandrel in said rolling engagement with said rollers;

f. a thrust collar adjustably fastenable along the length of said depth adjustment casing for rotatably locating said cage, rollers and mandrel said predetermined distance from the end of said tube to be expanded;

g. multiple cage extension segments of substantially equal length pivotably connected to each other end to end to form a flexible chain of segments, one of which segments is pivotably connected at one end of said chain to said tubular cage and another of which segments is pivotably connected at the other end of said chain of segments to said depth adjustment casing so that said entire chain of segments is pivotable into and out of coaxial alignment with said cage and said casing; and h. multiple mandrel extension links, for transmitting said force from said drive shaft to said mandrel, at least equal in number and substantially equal in length to said multiple cage extension segments and slidably carried in said said segments, each link pivotably attached to each other link end to end to form a flexible series of links, one of which links is pivotably connected at one end of said series to said mandrel and another one of which links is pivotably connected at the other end of said series to said drive shaft so that said entire series of links is pivotable into and out of coaxial alignment with said mandrel and said drive shaft when said chain of cage extension segments is pivoted into and out of coaxial alignment with said tubular cage and said depth adjustment casing.

6. A flexible tube expander as in claim 5 wherein said ends of each segment and said ends of each link pivot about pivot axes which are perpendicular to the rotation axis of said segment and which pivot axes are parallel to each other whereby said chain of segments and series of links are flexible in only one plane perpendicular to each of said pivot axes and whereby said mandrel and said cage are rotatable for tube expansion only when said chain of segments and series of links are pivoted into complete coaxial alignment along the axis of said tubular cage.

* * * * *